US010064450B1

(12) United States Patent
Groves-Hill

(10) Patent No.: US 10,064,450 B1
(45) Date of Patent: Sep. 4, 2018

(54) RETROFIT SHOE HEEL SYSTEM

(71) Applicant: Jessica S. Groves-Hill, Oakwood Village, OH (US)

(72) Inventor: Jessica S. Groves-Hill, Oakwood Village, OH (US)

( * ) Notice: Subject to any disclaimer, the term of this patent is extended or adjusted under 35 U.S.C. 154(b) by 0 days.

(21) Appl. No.: 15/499,838

(22) Filed: Apr. 27, 2017

Related U.S. Application Data

(60) Provisional application No. 62/358,028, filed on Jul. 3, 2016.

(51) Int. Cl.

| | |
|---|---|
| ***A43B 3/24*** | (2006.01) |
| ***A43C 15/04*** | (2006.01) |
| ***A43B 21/24*** | (2006.01) |
| ***A43B 21/42*** | (2006.01) |
| ***A43B 21/52*** | (2006.01) |

(52) U.S. Cl.
CPC ..... *A43C 15/04* (2013.01); *A43B 3/24* (2013.01); *A43B 21/24* (2013.01); *A43B 21/42* (2013.01); *A43B 21/52* (2013.01)

(58) Field of Classification Search
CPC ..... A43B 3/24; A43B 3/246; A43B 21/42; A43B 21/52
USPC ..... 36/15, 100, 36 R, 36 A, 36 B, 36 C, 41, 36/42
See application file for complete search history.

(56) References Cited

U.S. PATENT DOCUMENTS 3,035,357 A 10/1958 Valenti
3,270,442 A * 9/1966 Liebmann ..... A43B 3/0078 36/100
4,887,369 A * 12/1989 Bailey ..... A43B 3/24 36/101
5,044,097 A 9/1991 Young
7,059,068 B2 6/2006 Magallanes et al.
7,971,373 B2 * 7/2011 Epping ..... A43B 3/0078 36/42
8,033,035 B2 * 10/2011 Brown ..... A43C 13/00 36/36 R
8,112,908 B2 * 2/2012 Visser ..... A43B 21/46 36/100
8,141,275 B1 * 3/2012 Donaldson ..... A43B 21/52 36/72 B
9,015,963 B1 * 4/2015 Dominguez ..... A43B 21/42 36/100
9,332,806 B2 5/2016 Guardado
2002/0133980 A1 9/2002 Pan
(Continued)

*Primary Examiner* — Marie Bays
(74) *Attorney, Agent, or Firm* — Derek Pressley

(57) ABSTRACT

A retrofit shoe heel system for stiletto-heeled shoes has a heel outsole piece, a heel midsection piece, and a heel top piece. The heel outsole piece has a column extending therefrom with an open-end, hollow shaft running longitudinally therethrough which is sized and shaped to receive the stiletto heel of a shoe, and a ground contact surface area extending outwardly about the column which increases the shoe's heel ground contact area. The heel midsection piece has an outer contour substantially matching an outer contour of the outsole piece, and an aperture therethrough which is sized and shaped to surround the column of the outsole piece. The heel top piece has a skirt portion with an outer contour substantially matching an outer contour of the outsole piece, and an aperture therethrough which is sized and shaped to surround the column when stacked on top of the outsole piece.

7 Claims, 5 Drawing Sheets

(56) References Cited

U.S. PATENT DOCUMENTS

| | | | | |
|---|---|---|---|---|
| 2006/0196082 | A1* | 9/2006 | Robbins | A43B 3/24 36/42 |
| 2009/0282702 | A1* | 11/2009 | Brown | A43B 3/166 36/92 |
| 2015/0101210 | A1* | 4/2015 | Jang | A43B 13/36 36/42 |
| 2016/0015130 | A1* | 1/2016 | Knox | A43B 3/0078 36/136 |
| 2016/0198795 | A1* | 7/2016 | Lopez-Velasquez | A43B 21/42 36/100 |
| 2016/0235163 | A1* | 8/2016 | Alander | A43B 21/42 |

* cited by examiner

RETROFIT SHOE HEEL SYSTEM

CROSS REFERENCE TO RELATED APPLICATION

This application claims the benefit of U.S. Provisional Patent Application No. 62/358,028 filed Jul. 3, 2016 which application is hereby incorporated by reference.

BACKGROUND

Women's high-heel shoes made by sought after designers can be very expensive, with some costing in excess of $1,000 per pair. A lot of the value of these shoes is derived from their design which accentuates the appeal of women when wearing these tall, narrow high-heels. Paradoxically though, high-heels typically make it difficult for women to wear them and walk in them due to the minimal amount of support provide by them. This is especially true when worn on uneven, soft, or slippery surfaces, or when the wearer has difficulty in maintaining balance due to some type of incapacity. To further exacerbate this paradox, the value of these designer shoes can be destroyed if their design is permanently altered by changing the heel.

Efforts have been made to provide an answer to this paradox, but the answers to date are rather lacking. For example, U.S. Pat. No. 8,033,035 to Brown et al. discloses an accessory for stiletto heels which may be temporarily slipped over the existing heel to increase the support provided by the heel. But, it's not very aesthetically pleasing and is generally not something women would desire to use. Another example is U.S. Pat. No. 9,332,806 to Guardado which discloses a high-heel shoe with a convertible heel designed into the shoe. A secondary heel can be folded down out of a stowage cavity, that then rotates and locked into place. It's a rather complicated design however, and would quite likely cost a great deal more to manufacture.

An object of the present invention is to provide an aesthetically pleasing, retrofit shoe heel system that can be temporarily placed over existing narrower high-heels of different heights.

SUMMARY OF INVENTION

One preferred embodiment of a retrofit shoe heel system for stiletto-heeled shoes involves a heel outsole piece, a heel midsection piece, and a heel top piece. The heel outsole piece has a column extending therefrom with an open-end, hollow shaft running longitudinally therethrough which is sized and shaped to receive the stiletto heel of a shoe, and a ground contact surface area extending outwardly about the column which increases the shoe's heel ground contact area. The heel midsection piece has an outer contour substantially matching an outer contour of the outsole piece, and an aperture therethrough which is sized and shaped to surround the column of the outsole piece. The heel top piece has a skirt portion with an outer contour substantially matching an outer contour of the outsole piece, and an aperture therethrough which is sized and shaped to surround the column when stacked on top of the outsole piece.

Other objects and advantages of the present invention will become apparent from the following descriptions, taken in connection with the accompanying drawings, wherein, by way of illustration and example, a preferred embodiment of the present invention is disclosed.

BRIEF DESCRIPTION OF THE DRAWINGS

The drawings constitute a part of this specification and include a preferred embodiment of the invention, which may be achieved in various forms. It is to be understood that in some instances various aspects of the invention may be shown exaggerated or enlarged to facilitate an understanding of the invention.

DETAILED DESCRIPTION OF A PREFERRED EMBODIMENT

A detailed description of a preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
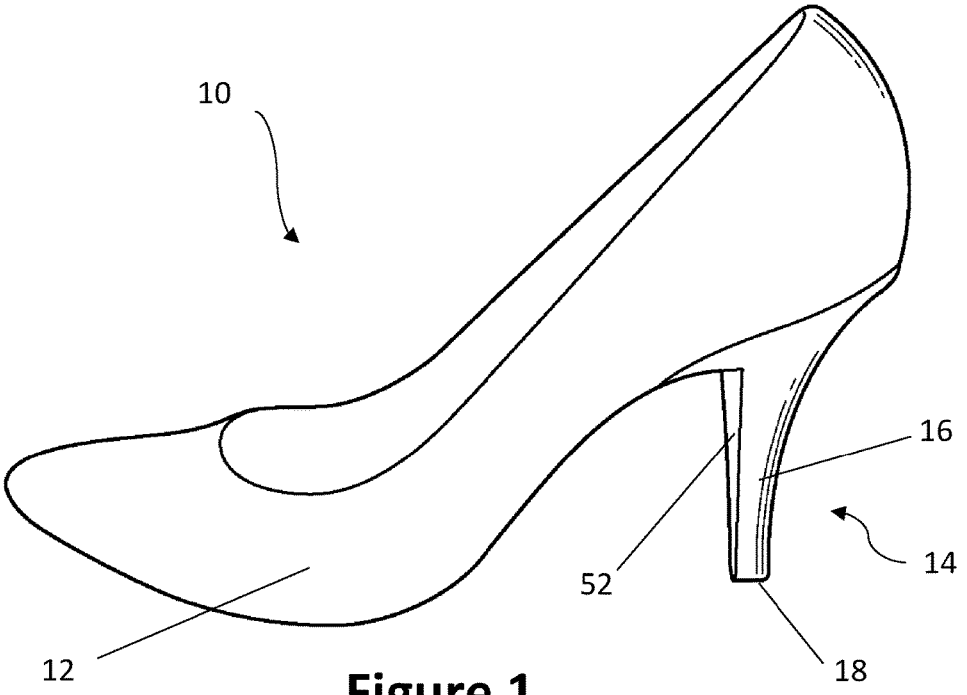
FIG. 1 shows a typical ladies' high-heel shoe.

FIG. 1 shows a typical ladies' high-heel shoe 10 (also known as a court shoe or pump, among other names), generally comprising an upper 12 with an approximately 3-inch tall high-heel 14. High-heel 14 (known as a stiletto heel, or when slightly shorter, a kitten heel) has a tall, narrow shaft 16 and ground contact surface area 18.

Figure 2:
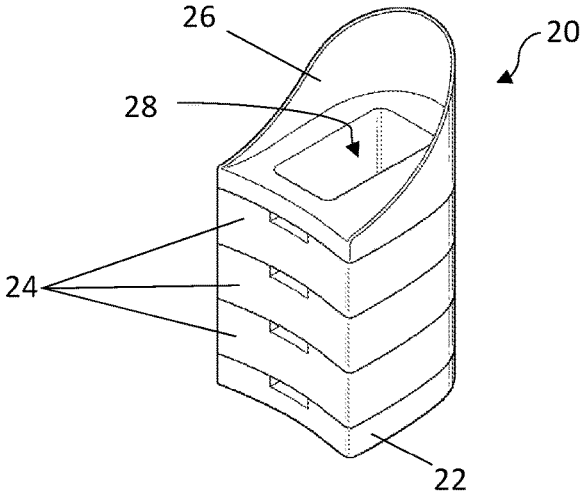
FIG. 2 shows a preferred embodiment of a retrofit shoe heel system according to the invention.
Figure 3:
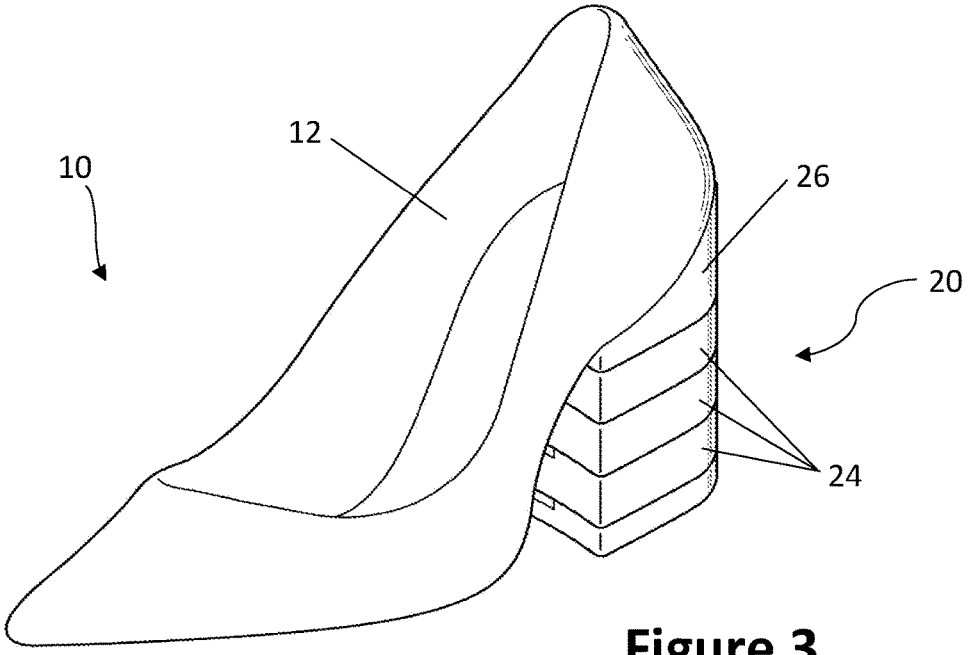
FIG. 3 shows the heel system of FIG. 2 used on the shoe of FIG. 1.
Figure 4:
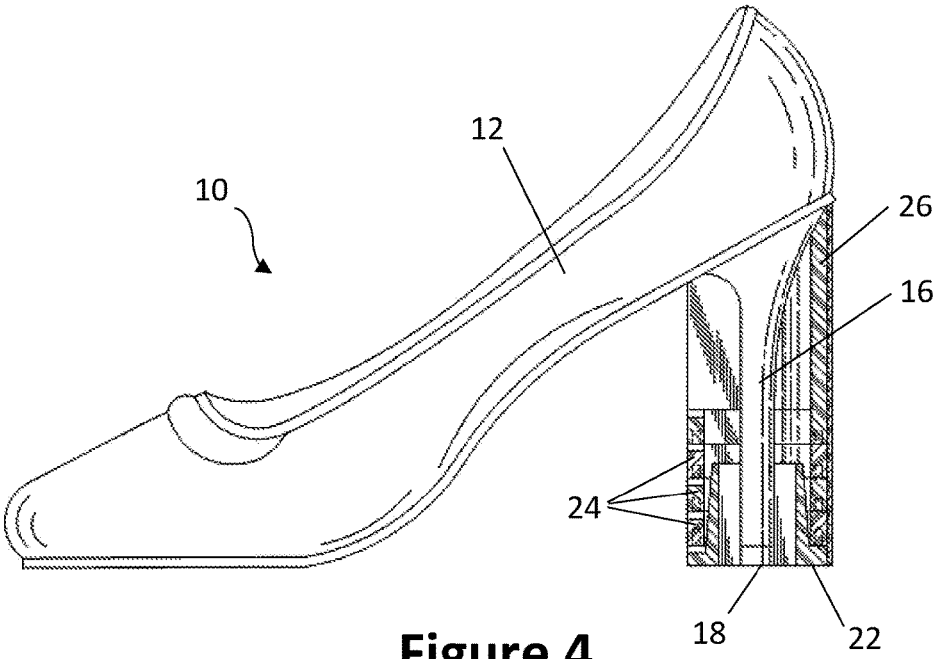
FIG. 4 shows a cross-section of the heel system of FIGS. 2 and 3.

FIG. 2 shows a preferred embodiment of a retrofit shoe heel system 20 that generally comprises heel outsole piece 22, one or more lift midsections pieces 24 and heel top piece 26. FIG. 3 shows heel system 20 applied to shoe 10 with three ½-inch tall lift midsection pieces 24. Application of heel system 20 to shoe 10 is accomplished by inserting heel 14 into opening 28 (FIG. 2), such that end 18 is substantially flush with the bottom of heel outsole piece 22 as shown in FIG. 4. It should be appreciated by one of ordinary skill in the art that heel system 20 is designed to accommodate heels of different heights, where a varying number of lift midsection pieces can be used to enclose the shoe's existing heel. For example, when heel system 20 is desired to be put into use with a shorter kitten heel, only one or two lift sections may be required to enclose the heel's shaft (16 of stiletto heel 14).

Figure 5:
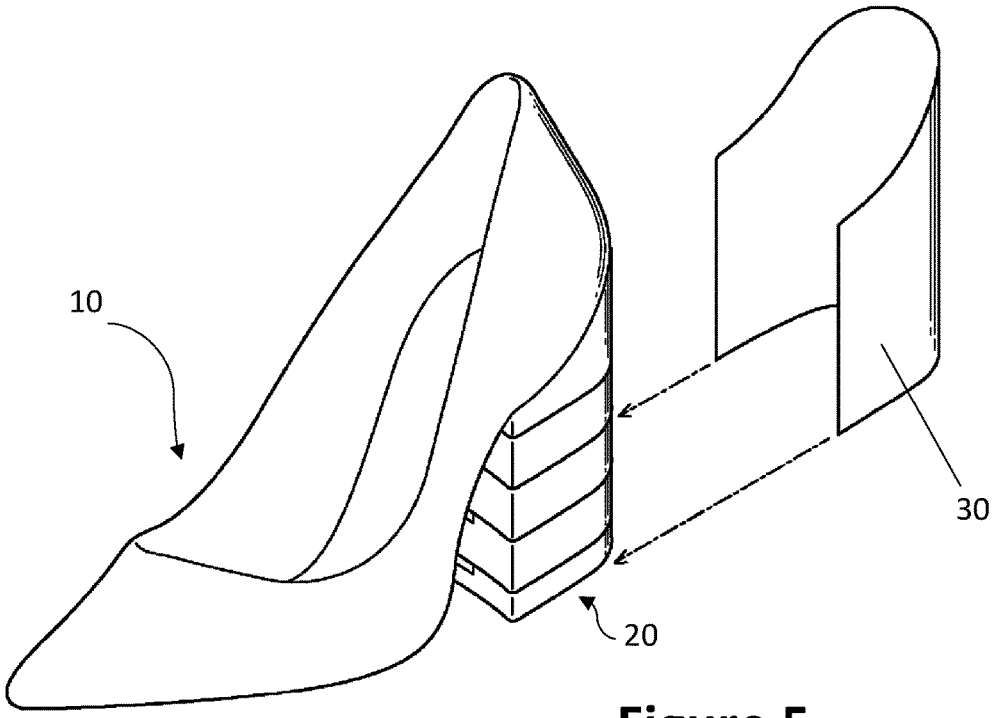
FIGS. 5 and 6 show application of a heel cover of the heel system.
Figure 6:
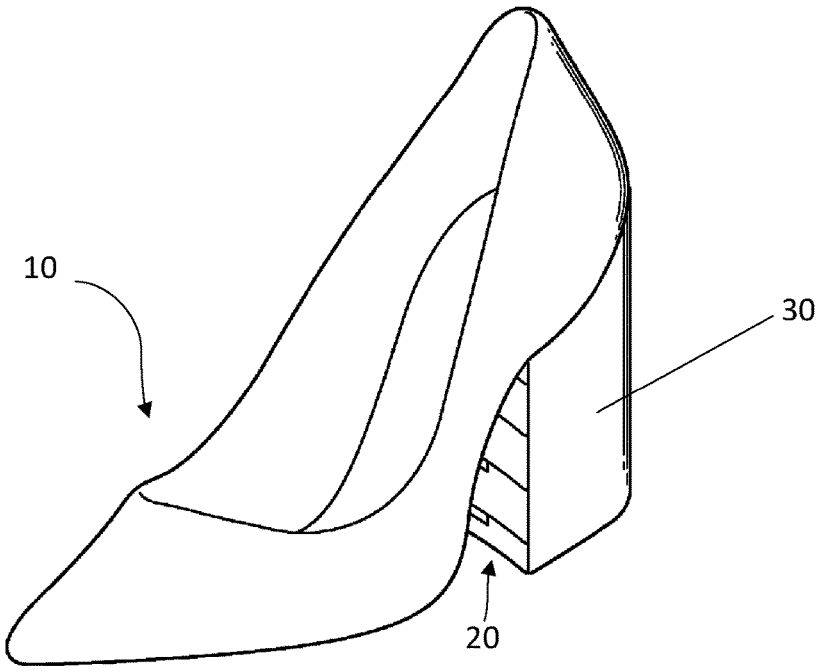

FIG. 5 shows that the heel system may include heel cover 30 which may be applied around the heel outsole piece, midsection pieces and top piece as shown in FIG. 6 to give it an aesthetically pleasing appearance. Cover 30 can be affixed to heel system 20 in differing degrees of permanency depending upon the particular circumstances, such as by more permanent types of gluing or by more temporary means such as by stick-on type hook-and-loop fastener arrangements, for example. Alternatively, each midsection piece may have a cooperating fastener part incorporated thereon that is connectable to a mating fastener part affixed to the heel cover.

Figure 7:
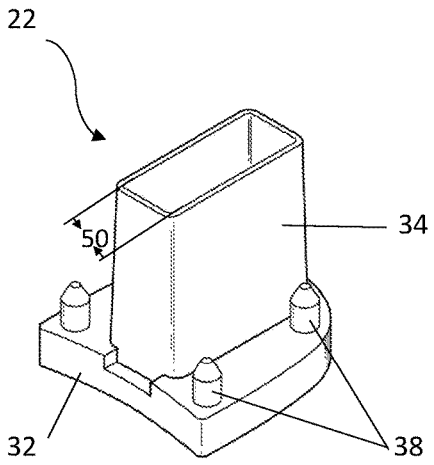
FIGS. 7 and 8 show views of the heel outsole piece of the heel system of FIGS. 2-4.
Figure 8:
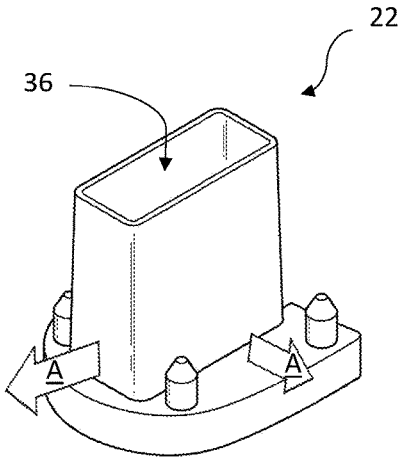

FIGS. 7 and 8 show views of heel outsole piece 22 used in heel system 20 of FIG. 2. It has a generally planar outsole bottom 32, a centrally located column 34 with open-ended shaft 36 therethrough, and a plurality of posts 38 arranged around the column that help to align the lift sections. Outsole bottom 32 extends outwardly (shown by arrows A) about column 34 to increase the shoe's heel ground contact surface area when applied to a shoe.

Figure 9:
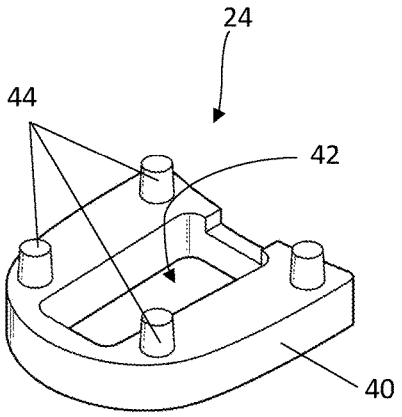
FIGS. 9 and 10 show top and bottom views, respectively, of a heel midsection piece used in the heel system of FIGS. 2-4.
Figure 10:
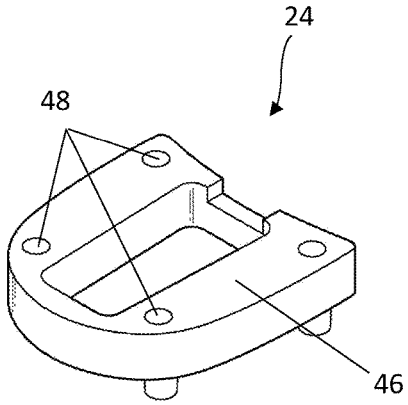
Figures 11A, 11B:
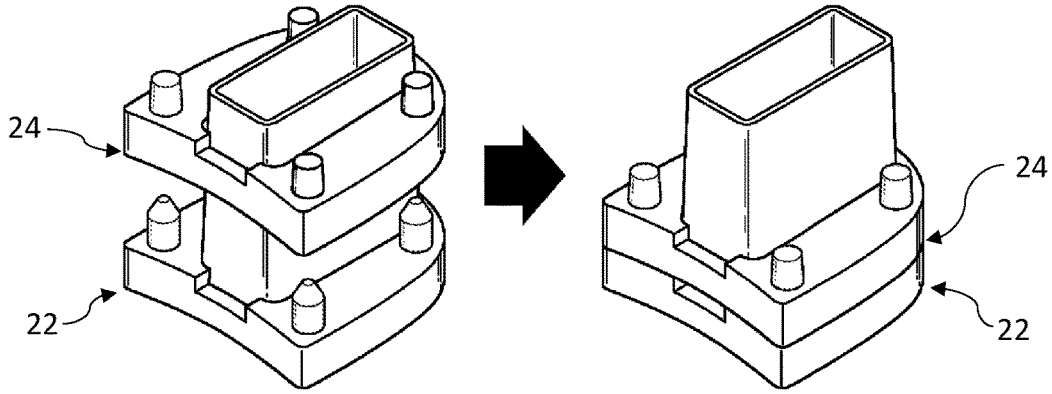
FIGS. 11A and 11B show assembly of a heel midsection piece onto a heel outsole piece.

FIGS. 9 and 10 show lift midsection piece 24 used in heel system 20. It has a generally planar body portion 40 with a centrally located aperture 42 therethrough that is sized and shaped to fit over column 34 of outsole piece 22 as shown in FIGS. 11A and 11B. A plurality of posts 44 are arranged around aperture 42. FIG. 10 shows that bottom 46 has a plurality of recesses 48 which are arranged and sized to receive posts of another midsection piece or posts of the outsole piece as shown in FIGS. 11A and 11B.

FIGS. 11A and 11B show how midsection piece(s) 24 can be stacked on top of the outsole piece 22 to make a block-heel-style shoe heel with a wide outsole contour capable of providing more support to the shoe wearer's foot.

It is contemplated as part of the invention that heel system 20 may be held in place upon stiletto heel 14 in one of several different ways. For example, heel system 20 may be held in place with an interference, frictional connection between heel shaft 16 and column 34 of outsole piece 22. That is, width 50 of open-ended shaft 36 (FIG. 7) may be sized narrower than width 52 of heel shaft 16 (FIG. 1), such that heel shaft 16 must be forcibly inserted through shaft 36 to align end 18 with the bottom of heel outsole piece 22 as shown in FIG. 4. Another example involves inserting a wedge piece (not shown) within shaft 36, adjacent heel shaft 16 to fix the relationship between them. And, yet a further example involves inserting a flexible ring member around shaft 16 such that it occupies the space between shaft 16 and the walls of open-ended shaft 36.

While the invention has been illustrated and described in detail in the drawings and foregoing description, the same is to be considered as illustrative and not restrictive in character, it being understood that only one preferred embodiment has been shown and/or described and that all changes and modifications that come within the spirit of the invention are desired to be protected.

What is claimed is:

1. A retrofit shoe heel system for stiletto-heeled shoes, comprising:

a heel outsole piece with a column extending therefrom having an open-end, hollow shaft running longitudinally therethrough which is sized and shaped to receive the stiletto heel of a shoe, and a ground contact surface area extending outwardly about said column which increases the shoe's heel ground contact area;

a heel midsection piece with an outer contour substantially matching an outer contour of said outsole piece, and an aperture therethrough which is sized and shaped to surround said column when stacked on top of said outsole piece, and a heel top piece with a skirt portion having an outer contour substantially matching an outer contour of said outsole piece, and an aperture therethrough which is sized and shaped to surround said column when stack on top of said outsole piece.

2. The retrofit shoe heel system of claim 1, wherein each of said heel pieces further comprise structure that cooperatively work to maintain a stacked relationship when said midsection piece is stacked upon said outsole piece or when said top piece is stacked upon either of said midsection or outsole pieces.

3. The retrofit shoe heel system of claim 1, wherein the upper end of said skirt portion terminates in a lip contoured to meet the bottom portion of the shoe's upper.

4. A retrofit shoe heel system for stiletto-heeled shoes, comprising:

a heel outsole piece with a column extending therefrom having an open-end, hollow shaft running longitudinally therethrough sized and shaped to receive the stiletto heel of a shoe, and a ground contact surface area extending outwardly about said column which increases the shoe's heel ground contact area; and a heel top piece with a skirt portion having an outer contour substantially matching an outer contour of said outsole piece, and aperture therethrough which is sized and shaped to surround said column when stack on top of said outsole piece.

5. The retrofit shoe heel system of claim 4, further comprising a heel midsection piece with an outer contour substantially matching said outer contour of said outsole piece, and an aperture therethrough sized and shaped to surround said column when stacked on top of said outsole piece.

6. The retrofit shoe heel system of claim 5, wherein each of said heel pieces further comprise structure that cooperatively work to maintain a stacked relationship when said midsection piece is stacked upon said outsole piece or when said top piece is stacked upon either of said midsection or outsole pieces.

7. The retrofit shoe heel system of claim 4, wherein the upper end of said skirt portion terminates in a lip contoured to meet the bottom portion of the shoe's upper.

* * * * *